US006680580B1

(12) United States Patent
Sung

(10) Patent No.: US 6,680,580 B1
(45) Date of Patent: Jan. 20, 2004

(54) DRIVING CIRCUIT AND METHOD FOR LIGHT EMITTING DEVICE

(75) Inventor: Chih-Feng Sung, Miaoli Hsien (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 10/065,631

(22) Filed: Nov. 5, 2002

(30) Foreign Application Priority Data

Sep. 16, 2002 (TW) ..... 91121105 A

(51) Int. Cl.[7] ..... G09G 3/30

(52) U.S. Cl. ..... 315/169.3; 345/92; 345/82

(58) Field of Search ..... 315/169.1–169.4; 345/82–86, 55, 62, 65, 72, 75, 76, 92

(56) References Cited

U.S. PATENT DOCUMENTS 5,095,248 A * 3/1992 Sato ..... 315/169.3
6,509,692 B2 * 1/2003 Komiya ..... 315/169.3
6,580,408 B1 * 6/2003 Bae et al. ..... 345/76

* cited by examiner

*Primary Examiner*—Wilson Lee
(74) *Attorney, Agent, or Firm*—Jiang Chyun IP Office

(57) ABSTRACT

A driving circuit for a light emitting device is suitable for use in an active matrix organic light emitting diode (AMOLED) display, which has a scanning line to be input with a scanning clock signal, so as to control the driving circuit. The driving circuit includes a driving circuit main part which includes a light emitting device driven by a driving transistor as well as a scan line connection terminal and a data line connection terminal. The scan line connection terminal receives a scanning clock signal. A first transistor has a gate connected to this scan line connection terminal, a source. connected to the data line connection terminal, and a drain connected to a gate electrode of the driving transistor. A second transistor has a gate electrode connected to the scan line connection terminal, a source connected to a common voltage, and a drain connected to an anode of the light emitting device. The common voltage has a high voltage level and a low voltage level, alternating by a frequency, wherein the high voltage level of the common voltage is higher than a system low voltage and the low voltage level is smaller than the system low voltage. When the first transistor and the second transistor are simultaneously activated by the scanning clock signal, the data line can be input with an image digital data voltage or a negative turning-off voltage. When the common voltage is at the low voltage level, the turning-off voltage is input, so as to turn off the driving transistor and the light emitting device.

22 Claims, 3 Drawing Sheets

Frame Inverse

| Frame One | Frame Two |
|---|---|
| on on on on ..... | off off off off ..... |
| on on on on ..... | off off off off ..... |
| on on on on ..... | off off off off ..... |
| on on on on ..... | off off off off ..... |
| ⋮ | ⋮ |

FIG. 6A

Line Inverse

| Frame One | Frame Two |
|---|---|
| on on on on ..... | off off off off ..... |
| off off off off ..... | on on on on ..... |
| on on on on ..... | off off off off ..... |
| off off off off ..... | on on on on ..... |
| ⋮ | ⋮ |

FIG. 6B

DRIVING CIRCUIT AND METHOD FOR LIGHT EMITTING DEVICE

CROSS REFERENCE TO RELATED APPLICATIONS

This application claims the priority benefit of Taiwan application serial no. 91121105, filed on Sep. 16, 2002.

BACKGROUND OF INVENTION

1. Field of Invention

The present invention generally relates to a light emitting device display technique, and more particularly, to a driving technique of the active matrix organic light emitting diode (AMOLED), so as to increase the driving voltage of the light emitting device as well as the stability with regard to the time passed by.

2. Description of Related Art

Accompanying the development of high technology, video products, especially the digital video or image devices, have become a popular product in our daily life. Within these digital video or image devices, display devices are an important element for displaying the related information. The users can read the information from the display further to control the device operation.

In order to comply with modern life, the size of the video or image device is getting thinner and lighter. The conventional Cathode Ray Tube (CRT) display occupies a large capacity and consumes more electricity. Therefore, complying with photoelectron and semiconductor manufacturing technologies, the panel display device has been developed and has become a common used display product, like the LCD or the active matrix organic light emitting diode display.

LCD technology has developed for several years, so it is hard to have a breakthrough now. However, the active matrix organic light emitting diode (AMOLED) display technology, a newly developed technology, will be main stream of the display device accompanying LCD in the future. The major feature of the AMOLED display is using TFT technique to drive the organic light emitting diode, and the driving IC is installed on the panel directly, so as to fulfill the requirement of being light/thin/short/small in volume and reducing cost. The AMOLED display can be applied on the medium or small size panel in cellular phone, PDA, digital camera and palm game player, portable DVD player and the automobile global positioning system, which can even be implemented in a large size panel like computer and plane TV in the future.

The digital display is characterized by a display screen composed of multiple pixels in a matrix arrangement manner. In order to control individual pixels, a specific pixel is commonly selected via a scanning line and a data line, and an appropriate operating voltage is also provided, so as to display the display information corresponding to this pixel. FIG. 1 schematically shows a sketch map of an AMOLED circuit that drives a corresponding pixel in the prior art. Referring to FIG. 1, the driving circuit comprises transistors 100 and 102. The transistor is such as the thin film transistor (TFT). A gate of the transistor 100 connects to the scanning line and receives a scanning voltage Vscan at an appropriate point of time, and a source of the transistor 100 also receives a digital data voltage Vdata sent from the data line at this point of time. A drain of the transistor 100 connects to a gate of the transistor 102. Generally speaking, the source and the drain of the transistor are swappable. The case shown in the present invention is only exemplified here for description. In addition, a storage capacitor 106 is connected in between the gate of the transistor 102 and a grounded voltage. The drain of the transistor 102 connects to a voltage source $V_{DD}$, the source of the transistor 102 further connects to an anode of the organic light emitting device 104, and a cathode of the organic light emitting device 104 connects to a corresponding low voltage $V_{SS}$.

The operation principle of the driving circuit shown in FIG. 1 mentioned above is described as follows. When the gate of the transistor 100 is activated by receiving the Vscan provided by the scanning line, the digital data voltage Vdata is input into the gate of the transistor 100, so as to activate the transistor 102. Meanwhile, the voltage source $V_{DD}$ flows into the organic light emitting device 104 via the transistor 102, and makes it emit the light. The transistor 102 is also generally called a driving device. When the circuit is operating, the scanning line clock Vscan is input into the transistor 100 with a pre-determined frequency, and the time period between its clock pulses is also called a frame. A pre-determined image data block is input into the corresponding pixel during a time period of the frame. When the scanning line clock pulse Vscan activates the transistor 100, the transistor 102 is also subsequently activated by the digital data voltage, and the digital data voltage Vdata is also stored in the storage capacitor 106, so as to maintain the activation of the transistor 102.

Therefore, the conventional organic light emitting device 104 always stays in the activation state in any of the frames. The variance only exists in the fact that the conventional voltage Vdata has different display gray scales in different frames. In other words, the light emitting device of the TFT-AMOLED always makes it stay at the emitting state in the conventional design. Conventionally, such emitting method complies with the image display effect and is able to avoid the picture flicking. In order to have the light emitting device continuously be driven, relatively, the transistor 102 must maintain its activation state.

However, when the light emitting device 104, such as the organic light emitting diode, is operated for a long time period, there is a driving current continuously flowing through the light emitting device 104. Therefore, its characteristic such as the driving voltage $V_{OLED}$ increases over time. Thus, the light emitting state of the light emitting device, such as the variances of the brightness and color, are impacted as shown in FIG. 2. The relationship between the effect caused by the deviation of the driving voltage $V_{OLED}$ and the driving circuit cooperated with the TFT is described hereinafter.

When the organic light emitting device 104 is activated, the TFT driving current $I_D$ has a relationship as shown in formula (1)–(4):

$$I_D=\tfrac{1}{2}k(V_{Ss}-V_{th})^2 \quad (1)$$

$$I_D=\tfrac{1}{2}k(V_G-V_S-V_{th})^2 \quad (2)$$

$$V_S=V_{OLED}+V_{SS} \quad (3)$$

$$I_D=\tfrac{1}{2}k(V_G-V_{OLED}-V_{SS}-V_{th})^2 \quad (4)$$

where k is a TFT characteristic constant, $V_G$=Vdata, and $V_{OLED}$ is the driving voltage of the light emitting device 104. As shown in the formula (1) (4) above, when the driving voltage $V_{OLED}$ increases, since it is activated for a long time, the driving current $I_D$ flowing through the organic light emitting device 104 reduces accordingly, thus impacts the light emitting condition of the organic light emitting device 104, and the brightness is also reduced accordingly. The life of the organic light emitting device 104 depends on its light emitting capability. Therefore, the variance of the driving voltage $V_{OLED}$ greatly impacts the organic light emitting device 104.

In addition, similarly, when the transistor 102 is activated for a long time, its threshold voltage Vth increases accordingly. The threshold voltage Vth is the same as the driving voltage $V_{OLED}$, the current flowing through the light emitting device 102 reduces when the threshold voltage Vth increases. Therefore, the threshold voltage Vth further deteriorates the light emitting quality.

SUMMARY OF INVENTION

Therefore, the present invention provides a driving circuit for the light emitting device, able to avoid the deviation of the driving voltage $V_{OLED}$ of the light emitting device, and at least maintaining the driving voltage $V_{OLED}$ on a stable value even under a long time operation of displaying image, so as to efficiently improve the display product quality. Furthermore, the threshold voltage Vth can also maintain a stable value without any deviation.

The present invention provides a driving circuit for a light emitting device, suitable for use in an active matrix organic light emitting diode (AMOLED), which has a scanning line to be input with a scanning clock signal, so as to control the driving circuit. The driving circuit includes a driving circuit main part which includes a light emitting device driven by a driving transistor as well as a scan line connection terminal and a data line connection terminal. The scan line connection terminal receives a scanning clock signal. A first transistor has a gate connected to this scan line connection terminal, a source connected to the data line connection terminal, and a drain connected to a gate electrode of the driving transistor. A second transistor has a gate electrode connected to the scan line connection terminal, a source connected to a common voltage, and a drain connected to an anode of the light emitting device. The common voltage has a high voltage level and a low voltage level, alternating by a frequency, wherein the high voltage level of the common voltage is higher than a system low voltage and the low voltage level is smaller than the system low voltage. When the first transistor and the second transistor are simultaneously activated by the scanning clock signal, the data line can be input with an image digital data voltage or a negative turning-off voltage. When the common voltage is at the low voltage level, the negative turning-off voltage is input, so as to turn off the driving transistor and the light emitting device.

As described above, the light emitting device mentioned above comprises an organic light emitting diode.

As described above, the high voltage level of the common voltage mentioned above is 0 V, and the low voltage level mentioned above is a negative voltage.

As described above, the negative turning-off voltage mentioned above is smaller than the low voltage level of the common voltage mentioned above.

As described above, when the first transistor and the second transistor mentioned above are simultaneously activated by the scanning clock signal mentioned above, the data line mentioned above can be input with an image digital data voltage mentioned above to display an image.

As described above, the frequency of the common voltage mentioned above varies in a period of one frame to drive an ON/OFF state of the corresponding multiple scanning lines, so as to achieve a frame inverse operation.

As described above, the frequency of the common voltage mentioned above uses the scanning line as one unit according to the scanning clock signal mentioned above, so as to achieve a line inverse operation.

BRIEF DESCRIPTION OF DRAWINGS

The accompanying drawings are included to provide a further understanding of the invention, and are incorporated in and constitute a part of this specification. The drawings illustrate embodiments of the invention, and together with the description, serve to explain the principles of the invention. In the drawings, FIG. 1 schematically shows a sketch map of a AMOLED circuit that drives a corresponding pixel in the prior art;

FIG. 6A schematically shows a mechanism of a frame inverse operation according to the present invention; and FIG. 6B schematically shows a mechanism of a line inverse operation according to the present invention.

DETAILED DESCRIPTION

One of the major characteristics of the present invention is providing a driving circuit for the light emitting device, able to avoid the deviation of the driving voltage $V_{OLED}$ of the light emitting device, and at least maintain the driving voltage $V_{OLED}$ on a stable value even under a long time operation of displaying image, so as to efficiently improve the display product quality. Furthermore, the threshold voltage Vth can also maintain a stable value without any deviation.

Considering the characteristics of the eye, the present invention can turn off the driving transistor of the light emitting device such as the TFT for a short time period without impacting the vision quality, so as to reset the threshold voltage. Therefore, the threshold voltage is not activated for a long time, and the threshold voltage tends to be stable without any deviation.

According to medical reports, a transient effect exists for human eyes. Human eyes cannot perceive the flickering when the image flickering frequency is above 60 Hz. That is, for example, the human eyes can not differentiate the light flickering of general light that is operated with a 60 Hz alternating current. When a frame is displaying an image, if the transient variance is faster than the frame variance, so as to turn off the light emitting device of the corresponding pixel, under such a situation, even though the total brightness may be reduced, the human eyes cannot perceive the flicking of the dark picture generated by the turn-off. However, the reduction of the brightness can be easily adjusted to compensate and achieve an expected brightness. Comparatively, such a problem is not so critical.

Figure 2:
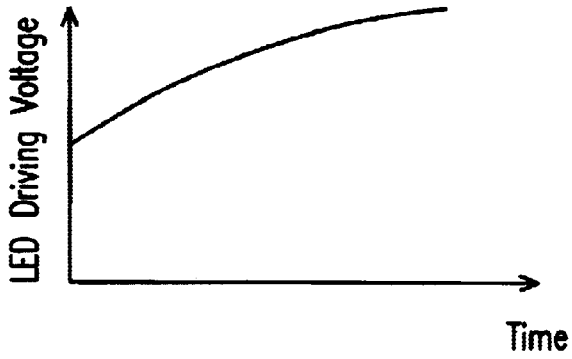
FIG. 2 (PRIOR ART)
FIG. 2 schematically shows a sketch map of a variance of the driving voltage of the light emitting device when it is varied with the activation time in the prior art.
Figure 3:
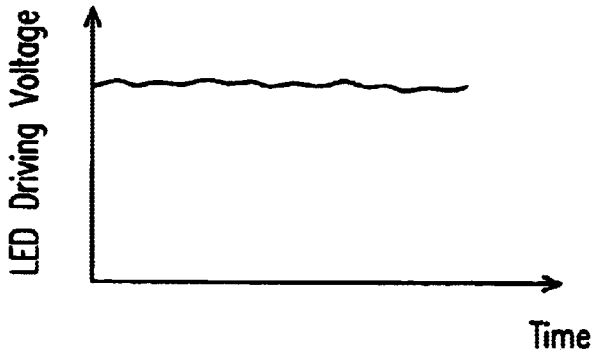
FIG. 3 schematically shows a sketch map of a variance of the driving voltage of the light emitting device when it is varied with the activation time according to the present invention.

FIG. 3 schematically shows a sketch map of a variance of the driving voltage of the light emitting device when it is varied with the activation time according to the present invention. The driving voltage of the light emitting device increases along with the increase of the display operation time when it is compared with the operation of the conventional driving circuit of FIG. 2. Contrarily, the present invention can achieve a stable driving voltage $V_{OLED}$. In order to obtain a stable $V_{OLED}$, the present invention modifies the design used in the conventional driving circuit as shown in FIG. 4.

Figure 1:
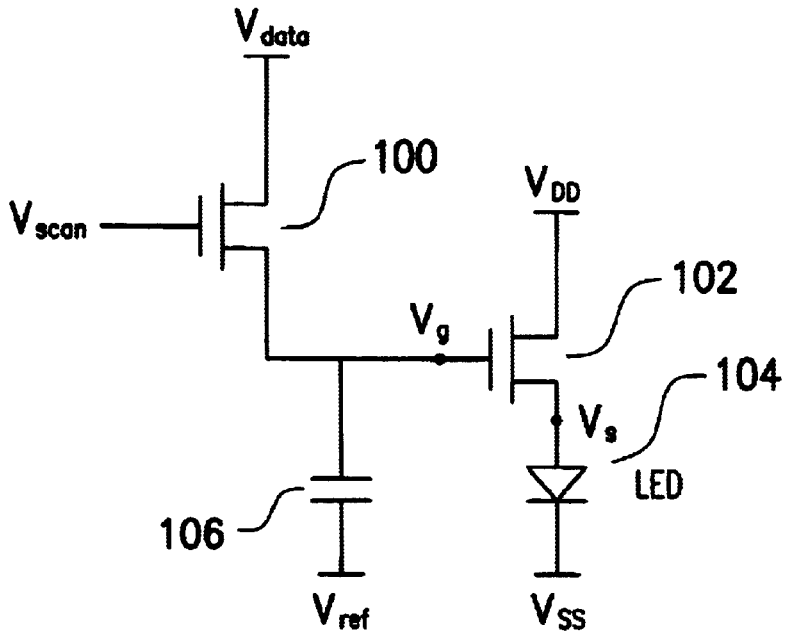
FIG. 1 (PRIOR ART)
Figure 4:
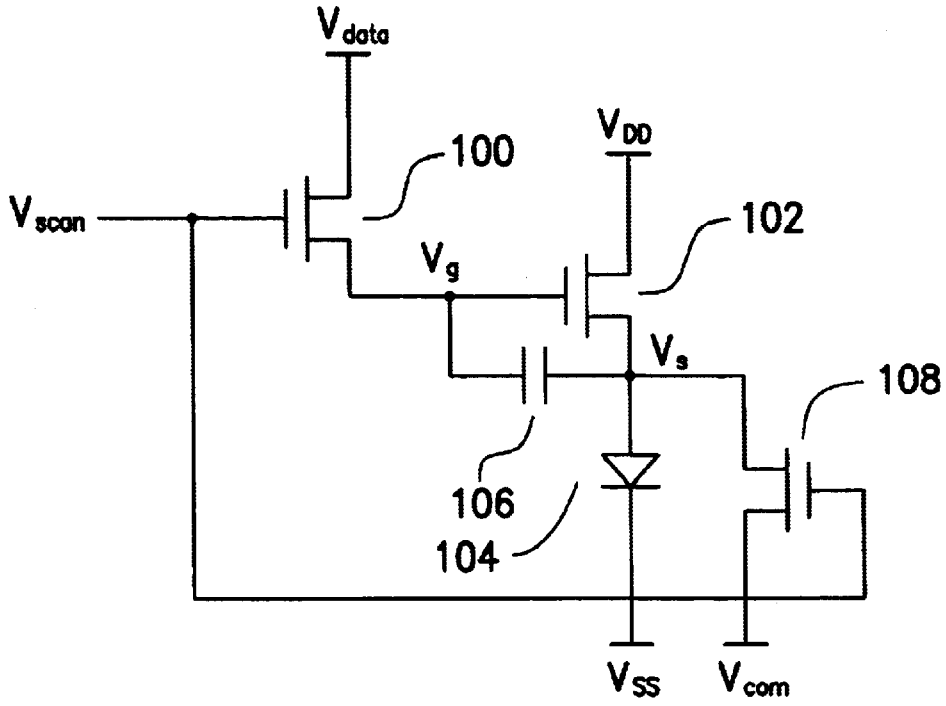
FIG. 4 schematically shows a sketch map of an AMOLED circuit that drives a corresponding pixel according to the present invention.

FIG. 4 schematically shows a sketch map of an AMOLED circuit that drives a corresponding pixel according to the present invention. As shown in FIG. 4, when it is compared with a circuit structure of FIG. 1, the present invention particularly adds a Field Effect Transistor (FET), such as a TFT 108. In addition, when it is cooperated with the clock variance, the present invention can temporarily turn off the light emitting device and the driving transistor 102, so that the driving voltage $V_{OLED}$ of the light emitting device 108 and the threshold voltage Vth of the transistor 102 can be reset. Therefore, it does not increase along with the increase of the display operation time.

The TFT 108 has a gate connected to the gate of the transistor 100 to simultaneously accept control from the scanning voltage. In addition, the drain of the TFT 108 connects to a control point of the light emitting device 104, such as connecting to an anode of the light emitting diode. The general transistor 102 and the light emitting device 104 constitute a light emitting path that is connected in between a system high voltage $V_{DD}$ and a system low voltage $V_{SS}$. The source $V_S$ of the transistor 102 and the anode of the light emitting diode 104 are jointly coupled to a node. Furthermore, the source of the TFT 108 also connects to a common voltage $V_{COM}$.

Regarding the maintain capacitor 106, an electrode of the capacitor 106 may be connected to the gate of the transistor 102, and the other electrode of the capacitor 106 can be grounded. However, it is also acceptable as shown in FIG. 4, to have the other electrode of the capacitor 106 connect to the source of the transistor 102 without impacting the characteristic of the present invention.

In addition to adding a TFT 108, the present invention can further achieve the function of temporarily turning off the transistor 102 and the light emitting device by cooperating with the voltage values and the clock relationship among the digital data voltage Vdata, the scanning voltage Vscan and the common voltage Vcom.

Figure 5:
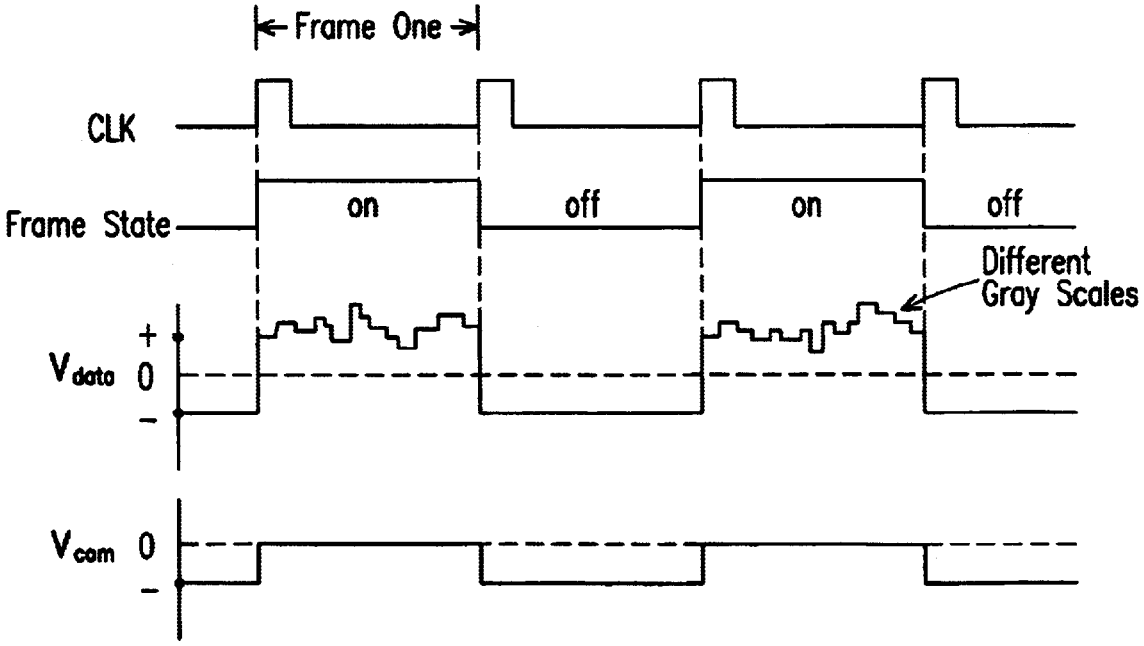
FIG. 5 schematically shows a clock controlling relationship of the driving circuit for the light emitting device shown in FIG. 4 when it is cooperated with the input voltage clock.

FIG. 5 schematically shows a clock controlling relationship of the driving circuit for the light emitting device shown in FIG. 4 when it is cooperated with the input voltage clock. The general display operation uses one frame as a time unit. Some corresponding scanning lines are activated within a frame. A scanning signal is input into the scanning line when it is cooperated with the frame size, providing a scanning voltage Vscan with a frequency along with the time variance for inputting into the gates of the transistors 100 and 108, so as to activate the transistors 100 and 108. In FIG. 5, a clock signal CLK is a clock having a frequency, and a frame is defined as a range between pulses. As to an image pixel unit, the variance of the scanning signal is the same as the variance of the clock signal CLK.

FIG. 5 is an example using the frame as a unit. With the same mechanism, the scanning line also can be used as a unit to perform the control operation. As shown in FIG. 5, in an example of using the frame as a unit, the frame state is set as an alternating relationship. When the frame is at an ON state, the corresponding scanning lines sequentially accept control from the scanning voltage Vscan, so as to activate the transistors 100 and 108. Meanwhile, the data lines are also sequentially input with the image data Vdata, so as to provide it to the transistor 100 of the corresponding pixel unit. The image data Vdata are the signals having different gray scales. Since the transistor 100 is activated, the image data Vdata can further activate the transistor 102. In addition, its voltage can be temporarily stored in the maintain capacitor 106, so as to maintain the transistor 102 in an ON state. When the transistor 102 is activated, a system high voltage $V_{DD}$ flows through the light emitting device 104, and arrives at a system low voltage $V_{SS}$, so that the light emitting device 104 can emit the light. As to the conventional driving method mentioned above, the transistor 102 and the light emitting device 104 are all kept in an ON state. Therefore, deviations of the threshold voltage of the transistor 102 and the driving voltage $V_{OLED}$ of the light emitting device 104 are generated.

The transistor 108 according to the present invention is further designed to cooperate with the operating voltage, so as to temporarily turn off the transistor 102 and the light emitting device 104 during a period when the frame is in an OFF state. The source of the transistor 108 connects to a common voltage Vcom, and the voltage level of the common voltage Vcom comprises a voltage high level and a voltage low level, which varies with a pre-determined frame ON/OFF state. For example, the voltage high level is a grounded voltage, and the voltage low level is a negative voltage. Furthermore, the digital data voltage Vdata is also cooperated with the common voltage Vcom, so as to be input with a negative voltage when it is at a voltage low level state. Therefore, it can achieve an objective of temporarily turning off the transistor 102 and the light emitting device 104 when the frame is in an OFF state.

The operating mechanism is described hereinafter. During the pre-determined frame OFF state, the common voltage Vcom is input with a negative voltage, such as −10 V. Meanwhile, a turning-off voltage, such as −20 V, is input into an input terminal of the digital data voltage. The system low voltage Vss is set as a grounded voltage, or a negative voltage, such as −5 V. The system low voltage Vss is generally designed to be in between the high level and low level of the common voltage Vcom. When the voltage low level of the common voltage Vcom is inversely input into the anode of the light emitting device 104, since the voltage low level of the common voltage Vcom is smaller than the system low voltage Vss, the light emitting device 104 can be deactivated. Furthermore, the relationship between the gate voltage Vg of the transistor 102 and the source voltage (i.e. anode voltage) $V_S$ of the transistor 102 has to be kept on a relationship of $Vg<V_S$. Meanwhile, the digital data voltage Vdata is input with a voltage, i.e. turning-off voltage, such as −20 V that is smaller than the voltage low level of the common voltage Vcom.

A frame inverse operation can be achieved by using the operating mechanism mentioned above. The so-called frame inverse operation is as shown in FIG. 5 and FIG. 6A, The ON/OFF is sequentially operated with a frame unit. A frame is generally corresponded to a whole image picture or a picture having different blocks. Therefore, a frame may comprise the pixels corresponding to multiple scanning lines. In FIG. 6A, all the corresponding scanning lines in frame 1 are at the ON state, so as to normally display the image. Contrarily, when it is cooperated with the operation of the turning-off voltage and the common voltage Vcom, those scanning lines in frame 2 are all at the OFF state. This is the so-called frame inverse operation. With the same driving circuit and the driving method, the clock of the turning-off voltage and the common. voltage Vcom can be adjusted, so as to achieve the line inverse operation. The so-called line inverse operation is as shown in FIG. 6B. In FIG. 6B, all the corresponding scanning lines in frame 1 are ON and OFF alternatively, and the corresponding scanning lines in frame 2 are also ON and OFF alternatively. However, frame 1 and frame 2 are just in reverse. This is the so-called line inverse operation. The driving circuit and the driving method applied is similar to the method shown in FIG. 6A, the only difference is in the clock adjustment.

Regarding the circuit design, the light emitting device 104 may be an organic light emitting diode. The transistor may be an N type or a P type transistor in terms of the conductive type. As to the integration of the driving method, the present invention is based on a conventional driving circuit, and further adding a transistor 108, when it is cooperated with the operating voltage and is operated with an appropriate clock, the frame inverse operation or the line inverse operation can be achieved.

The present invention at least can avoid the deviation of the threshold voltage of the driving transistor 102 and the driving voltage of the light emitting device 104, wherein the deviation is generated when the display operation time increases. The driving circuit for the light emitting device provided by the present invention at least can maintain the driving voltage $V_{OLED}$ on a stable value even it is under a long image display operation time, so as to efficiently improve the display product quality. Furthermore, the threshold voltage Vth can be maintained on a constant value without any deviation.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A driving circuit for a light emitting device, suitable for use in an active matrix organic light emitting diode (AMOLED) display, which has a scanning line to be input with a scanning clock signal, so as to control the driving circuit, the driving circuit comprising:

a driving transistor, having a gate connected to a first node; a light emitting device, serially connected to the driving transistor at a second node, so as to constitute a light emitting path, wherein, the light emitting path is connected in between a system high voltage and a system low voltage, when the driving transistor is activated, the system high voltage drives the light emitting device to make it emit the light;

maintain capacitor, connected to the first node, is able to maintain the driving transistor in an ON/OFF state according to a potential;

a first transistor, having a gate connected to a scanning line, a source connected to a data line, and a drain connected to the first node; and a second transistor, having a gate connected to the scanning line, a source connected to a common voltage, and a drain connected to the second node, wherein, the common voltage has a high voltage level and a low voltage level, alternating by a frequency, and the high voltage level of the common voltage is higher than a system low voltage and the low voltage level is smaller than the system low voltage, wherein, when the first transistor and the second transistor are simultaneously activated by the scanning clock signal, the data line is input either with an image digital data voltage or a negative turning-off voltage, when the common voltage is at the low voltage level, the negative turning-off voltage is input, so as to turn off the driving transistor and the light emitting device.

2. The driving circuit for the light emitting device of claim 1, wherein the high voltage level of the common voltage is 0V, and the low voltage level is a negative voltage.

3. The driving circuit for the light emitting device of claim 2, wherein the low voltage level is about −10 V, the system low voltage is about −5 V, and the turning-off voltage is about −20 V.

4. The driving circuit for the light emitting device of claim 1, wherein the negative turning-off voltage is smaller than the low voltage level of the common voltage.

5. The driving circuit for the light emitting device of claim 1, wherein when the first transistor and the second transistor are simultaneously activated by the scanning clock signal, the data line is input with the image digital data voltage, so as to display an image.

6. The driving circuit for the light emitting device of claim 1, wherein the frequency of the common voltage is varied with a period of one frame, so as to drive an ON/OFF state of the corresponding multiple scanning lines to achieve a frame inversion operation.

7. The driving circuit for the light emitting device of claim 1, wherein the frequency of the common voltage is based on the scanning clock signal, so as to use the scanning line as a unit to achieve a line inversion operation.

8. The driving circuit for the light emitting device of claim 1, wherein the light emitting device comprises an organic light emitting diode.

9. The driving circuit for the light emitting device of claim 1, wherein the first transistor, the second transistor, and the driving transistor, are either an N type TFT transistor or a P type TFT transistor.

10. The driving circuit for the light emitting device of claim 1, wherein the maintain capacitor is connected in between the first node and the second node.

11. The driving circuit for the light emitting device of claim 1, wherein the second node is an anode of the light emitting device.

12. A driving circuit for a light emitting device, suitable for use in an active matrix organic light emitting diode (AMOLED) display, which has a scanning line to be input with a scanning clock signal, so as to control the driving circuit, the driving circuit comprising:

a driving circuit main part, including a light emitting device driven by a driving transistor as well as a data line connection terminal and a scan line connection terminal, wherein, the scan line connection terminal receives a scanning clock signal;

a first transistor, having a gate connected to the scan line connection terminal, a source connected to the data line connection terminal, and a drain connected to a gate electrode of the driving transistor; and a second transistor, having a gate electrode connected to the scan line connection terminal, a source connected to a common voltage, and a drain connected to an anode of the light emitting device;

wherein, the common voltage has a high voltage level and a low voltage level, alternating by a frequency, and the high voltage level of the common voltage is higher than a system low voltage and the low voltage level is smaller than the system low voltage, when the first transistor and the second transistor are simultaneously activated by the scanning clock signal, the data line is input either with an image digital data voltage or a negative turning-off voltage, when the common voltage is at the low voltage level, the turning-off voltage is input, so as to turn off the driving transistor and the light emitting device.

13. The driving circuit for the light emitting device of claim 12, wherein the light emitting device comprises an organic light emitting diode.

14. The driving circuit for the light emitting device of claim 12, wherein the high voltage level of the common voltage is 0 V, and the low voltage level is a negative voltage.

15. The driving circuit for the light emitting device of claim 12, wherein the negative turning-off voltage is smaller than the low voltage level of the common voltage.

16. The driving circuit for the light emitting device of claim 12, wherein when the first transistor and the second transistor are simultaneously activated by the scanning clock signal, the data line is input with the image digital data voltage, so as to display an image.

17. The driving circuit for the light emitting device of claim 12, wherein the frequency of the common voltage is varied with a period of one frame, so as to drive an ON/OFF state of the corresponding multiple scanning lines to achieve a frame inversion operation.

18. The driving circuit for the light emitting device of claim 12, wherein the frequency of the common voltage is based on the scanning clock signal, so as to use the scanning line as a unit to achieve a line inversion operation.

19. A driving method for a light emitting device, suitable for use in an active matrix organic light emitting diode (AMOLED) display, which has a scanning line to be input with a scanning clock signal, so as to control the driving circuit, the driving method comprising:

providing a driving circuit main part, wherein the driving circuit main part includes a light emitting device driven by a driving transistor as well as a data line connection terminal and a scan line connection terminal, and the scan line connection terminal receives a scanning clock signal;

providing a first transistor, wherein the first transistor has a gate connected to the scan line connection terminal, a source connected to the data line connection terminal, and a drain connected to a gate electrode of the driving transistor;

providing a second transistor, wherein the second transistor has a gate electrode connected to the scan line connection terminal, a source connected to a common voltage, and a drain connected to an anode of the light emitting device;

providing a high voltage level and a low voltage level that are alternating by a frequency, and the high voltage level of the common voltage is higher than a system low voltage and the low voltage level is smaller than the system low voltage; and when the first transistor and the second transistor are simultaneously activated by the scanning clock signal, the data line is input either with an image digital data voltage or a negative turning-off voltage, when the common voltage is at the low voltage level, the turning-off voltage is input, so as to turn off the driving transistor and the light emitting device.

20. The driving method for the light emitting device of claim 19, wherein the high voltage level of the common voltage is 0 V, and the low voltage level is a negative voltage.

21. The driving method for the light emitting device of claim 19, wherein the negative turning-off voltage is smaller than the low voltage level of the common voltage.

22. The driving method for the light emitting device of claim 19, wherein when the first transistor and the second transistor are simultaneously activated by the scanning clock signal, the data line is input with the image digital data voltage, so as to display an image.

* * * * *

UNITED STATES PATENT AND TRADEMARK OFFICE

CERTIFICATE OF CORRECTION

PATENT NO. : 6,680,580 B1
DATED : January 20, 2004
INVENTOR(S) : Paul Rudeck

It is certified that error appears in the above-identified patent and that said Letters Patent is hereby corrected as shown below:

Column 6,
Line 31, replace “fabricated as unshaped” with -- fabricated as u-shaped --

Signed and Sealed this

Thirteenth Day of April, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,680,580 B1
DATED : January 20, 2004
INVENTOR(S) : Chih-Feng Sung

It is certified that error appears in the above-identified patent and that said Letters Patent is hereby corrected as shown below:

This certificate supersedes Certificate of Correction issued April 13, 2004, the number was erroneously mentioned and should be vacated since no Certificate of Correction was granted.

Signed and Sealed this

Fifteenth Day of June, 2004

JON W. DUDAS
*Acting Director of the United States Patent and Trademark Office*